US005469823A

United States Patent [19]

Ott et al.

[11] Patent Number: 5,469,823

[45] Date of Patent: Nov. 28, 1995

[54] SENSOR ARRANGEMENT FOR RAPID CYLINDER DETECTION IN A MULTI-CYLINDER INTERNAL COMBUSTION ENGINE

[75] Inventors: Karl Ott, Markgroeningen; Klaus Walter; Joachim Strate, both of Bietigheim-Bissingen, all of Germany

[73] Assignee: Robert Bosch GmbH, Stuttgart, Germany

[21] Appl. No.: 347,433

[22] PCT Filed: Mar. 18, 1994

[86] PCT No.: PCT/DE94/00298

§ 371 Date: Dec. 15, 1994

§ 102(e) Date: Dec. 15, 1994

[87] PCT Pub. No.: WO94/23192

PCT Pub. Date: Oct. 13, 1994

[30] Foreign Application Priority Data

Mar. 31, 1993 [DE] Germany ..... 43 10 460.6

[51] Int. Cl.[6] ..... F02P 5/00

[52] U.S. Cl. ..... 123/414

[58] Field of Search ..... 123/414, 612, 123/613, 614; 73/116

[56] References Cited

U.S. PATENT DOCUMENTS 4,941,446 7/1990 Denz et al. ..... 123/414
5,156,125 10/1992 Fukui et al. ..... 123/414
5,269,274 12/1993 Flaetgen et al. ..... 123/414
5,325,710 7/1994 Morikawa ..... 73/116
5,329,904 7/1994 Kokubo et al. ..... 123/414

FOREIGN PATENT DOCUMENTS 9312333 6/1993 WIPO ..... 123/414

*Primary Examiner*—Raymond A. Nelli
*Attorney, Agent, or Firm*—Michael J. Striker

[57] ABSTRACT

A sensor arrangement for cylinder detection in a multi-cylinder internal combustion engine is disclosed, having a crankshaft sensor with an increment disc with reference mark and a camshaft sensor with long and short segments as well as short and long intermediate spaces between the segments. By means of common evaluation of the pulse sequences supplied by the two sensors, the length of the high phases and low phases can be determined. Since the reference mark is also taken into account during the evaluation, the number of different segment lengths on the camshaft sensor disc can be reduced and a rapid and unambiguous cylinder detection can be achieved. The evaluation of the crankshaft signal and camshaft signal permits a reliable control of the internal combustion engine. In the event of failure of the crankshaft sensor, emergency running of the internal combustion engine can be realized solely with the aid of the camshaft sensor.

16 Claims, 2 Drawing Sheets

SENSOR ARRANGEMENT FOR RAPID CYLINDER DETECTION IN A MULTI-CYLINDER INTERNAL COMBUSTION ENGINE

PRIOR ART

The invention relates to a sensor arrangement for rapid cylinder detection in a multi-cylinder internal combustion engine of the generic type of the main claim.

It is known that in a four-stroke internal combustion engine the crankshaft rotates twice per work operation and thus passes through an angle of 720° before a specific cylinder assumes the same working position again. In order to detect the instantaneous position of a specific cylinder, it is therefore not sufficient to determine the angular position of the crankshaft within a revolution, but instead it is necessary to detect whether precisely the first or the second crankshaft revolution is taking place.

For this purpose, it is known, for example from the non prepublished German patent application P 41 41 13, to use, in addition to a crankshaft sensor which senses a disc with a plurality of marks and a reference mark formed by two missing mark, also a camshaft sensor which senses a disc connected to the camshaft. This disc has marks which are of different lengths, are matched to the number of cylinders and bring about in the sensor an output signal which can be used for cylinder identification.

For this cylinder identification, the two output signals are combined in the control device and the cylinder identification is carried out from the sequence thus obtained of high and low phases of different length.

This known arrangement has the disadvantage that a relatively complex evaluation is required and, for an unambiguous cylinder assignment it is necessary to evaluate the sequence of several segments, as a result of which a rapid ignition output is prevented.

A further sensor arrangement for cylinder detection in which a sensor disc which rotates in synchronism with the ignition distributor and is sensed by a detector has a plurality of shutter cutouts is known from the German Offenlegungsschrift DE-A 36 34 587, one of the said shutter cutouts being widened, and a disc which is connected to the crankshaft, has a reference mark and is sensed by a second detector furthermore being present. In this arrangement, under unfavourable circumstances the crankshaft must rotate twice before a cylinder identification is possible.

ADVANTAGES OF THE INVENTION

The sensor arrangement according to the invention for cylinder detection in a multi-cylinder internal combustion engine has, in contrast with the above, the advantage that a simple evaluation is possible and the number of different types of segment on the disc connected to the camshaft is minimal even with a large number of cylinders and, as a result, the different segments are clearly distinguished from one another.

These advantages are achieved in that not only the sequences of marks and segments of the camshaft disc is evaluated, but in addition also the occurrence of the reference mark is tested so that therefore a combination of the signals of camshaft sensor and crankshaft sensor is used for cylinder detection. However, so that such an evaluation is possible, it is necessary to ensure that an unambiguous assignment of crankshaft and camshaft is ensured.

It is particularly advantageous that the length of the high phases and of the low phases can take place by simply counting out the pulses produced by the multiplicity of marks of the crankshaft sensor. Furthermore, it is advantageous that an tunambiguous cylinder assignment can take place with the evaluation of only one segment and thus a rapid ignition output and also a rapid sequential injection in the case of starting is possible. Further advantageous embodiments of the sensor arrangement according to the invention are achieved with the features disclosed in the subclaims.

DESCRIPTION OF THE EXEMPLARY EMBODIMENT

Figure 1:
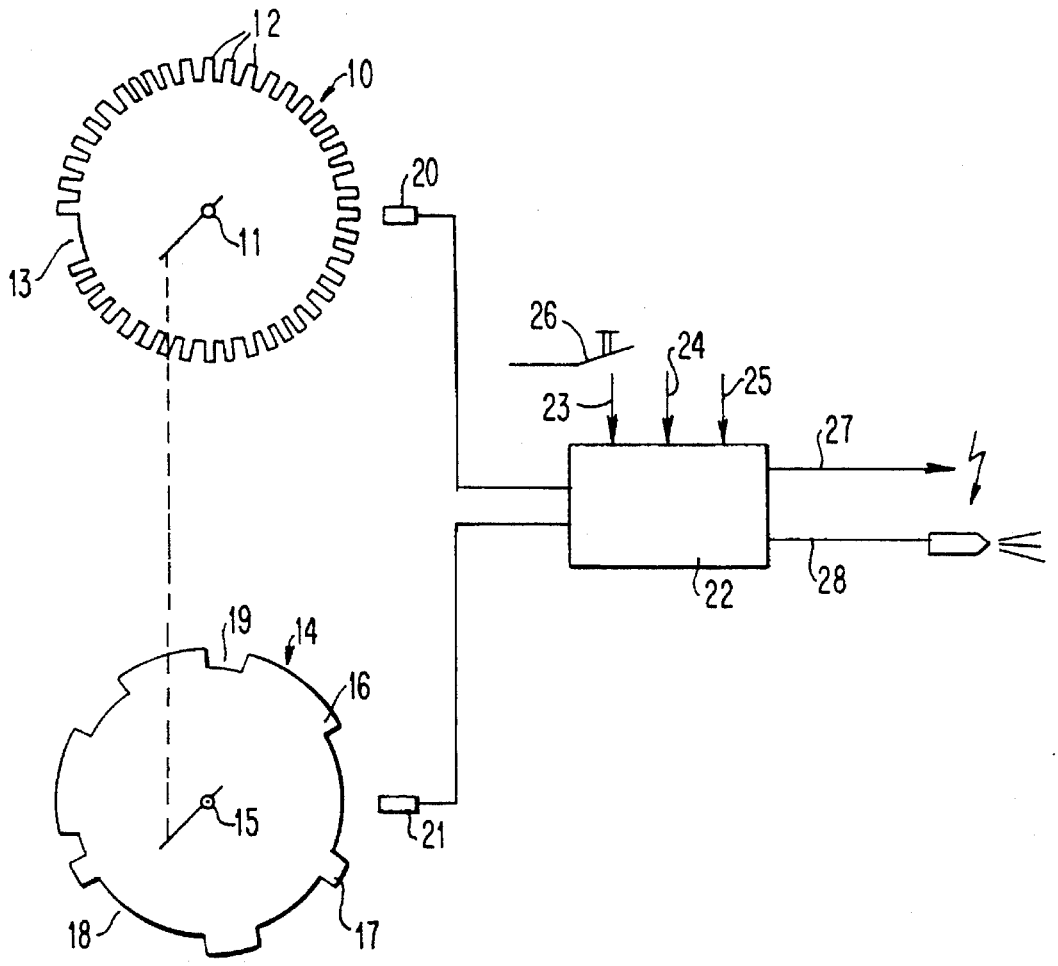
FIG. 1 shows a rough overview of the sensor arrangement according to the invention, in FIGS. 2(A–D) signal characteristics are disclosed which are obtained for sensor discs which are adapted to four, five or six cylinder internal combustion engines.

In FIG. 1, the most significant elements of the present invention in conjunction with an internal combustion engine control are illustrated in a rough overview. Such an arrangement is basically already known and has already been similarly disclosed for example in the patent application P 41 41 713 which has not yet been published.

In FIG. 1, 10 designates a sensor disc that is rigidly connected to the crankshaft 11 of the internal combustion engine and has on its circumference a multiplicity of angular marks 12 of the same kind. In addition to these angular marks 12 of the same kind, a reference mark 13 is provided which is formed for example by two missing angular marks.

A second sensor disc 14 is connected to the camshaft 15 of the internal combustion engine and has on its circumference segments which are of different lengths, the shorter ones being designated by 17 and the longer ones by 16. Between these angular marks or segments are intermediate spaces, the longer ones bearing the reference character 18, the shorter ones 19.

The sensor disc 14 illustrated in FIG. 1 is illustrated for a six-cylinder internal combustion engine, the number of segments 16, 17 is selected in such a way that it corresponds to the number of cylinders in the internal combustion engine. The exact arrangement of the angular marks and the assignment of the angular marks 16, 17 to the marks of the crankshaft sensor disc is to be made in such a way that the signal sequences illustrated in FIG. 2 are obtained. Appropriate arrangements are to be used for internal combustion engines with a different number of cylinders.

The two sensor discs 10, 14 are sensed by detectors 20, 21, for example inductive detectors or Hall sensors, the signals produced in the detectors when the angular marks pass by are fed to a control device 22 and further processed there. The sensor disc 10 and the detector 20 are designated below as crankshaft sensors, the sensor disc 14 and the detector 21 as camshaft sensors.

The control device 22 receives via inputs 23, 24, 25 further input variables which are required for the control of the internal combustion engine and are supplied by suitable sensors. On the output side, the control device 22 makes available signals for the ignition and injection for components (not designated in greater detail) of the internal combustion engine, the outputs of the control device 22 being designated by 27 and 28.

In FIG. 2, the signals which are supplied by the detectors 20 and 21, have already been processed to form square-wave signals and are evaluated in the control device are entered against the crankshaft angle or against the time t.

Figure 2A:
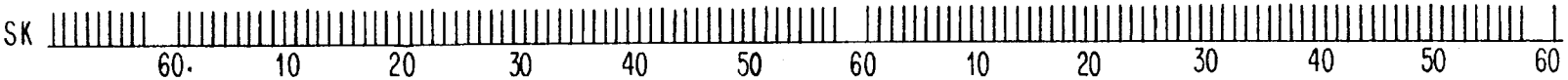

In particular, in FIG. 2*a* the prepared signal SK which has been supplied by the crankshaft sensor is entered. The number of angular marks is 60-2, the two missing angular marks forming the reference mark. Since one operating cycle of the internal combustion engine extends over two crankshaft revolutions, twice 60-2 pulses have to be produced by the crankshaft sensor with the selected arrangement.

Figure 2B:
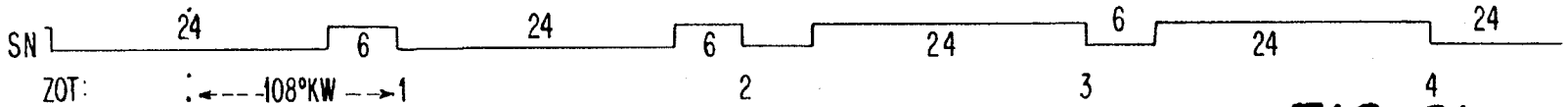

In FIG. 2*b*, the signal characteristic SN is illustrated for a four-cylinder internal combustion engine. In this case, the camshaft sensor disc has two different segments which lead to two different low phases and high phases in the signal. Since both the crankshaft sensor signal and the signal supplied by the camshaft sensor are evaluated, identical segments can be distinguished by the presence or absence of the reference mark in the segment.

Figure 2C:
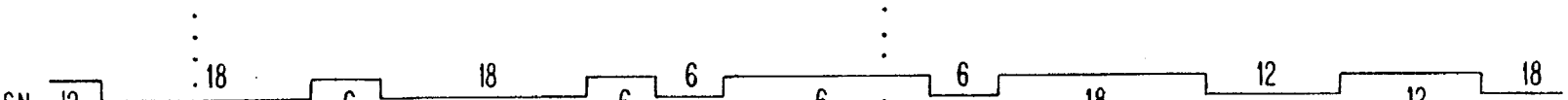

In FIG. 2*c*, the signal characteristic is illustrated for a five-cylinder internal combustion engine. Three different segments which lead to three different low phases and high phases are formed on the camshaft disc, identical segments can be distinguished by the presence or absence of the reference mark in the segment. The third segment can be distinguished from the other segments by the different low phases and high phases. In this case, it is also possible for the third segment to be characterized by low phases and high phases of the same size.

Figure 2D:
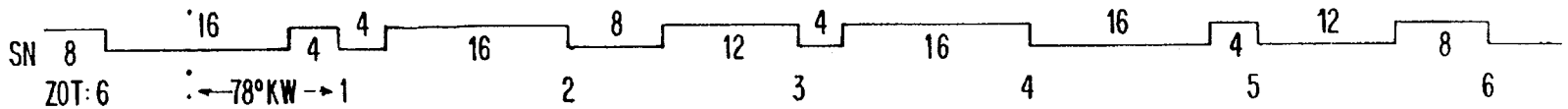

In FIG. 2*d*, the signal characteristic for a six-cylinder internal combustion engine is illustrated. In this case, the camshaft disc has four different segments which lead to four different low phases and high phases, identical segments being distinguished by the presence or absence of the reference mark in the segment, and the third and fourth segment being distinguished from the others by different low and high phases.

The signal sequences illustrated in FIG. 2 are evaluated in the control device 22 of the internal combustion engine. In this process, the signals according to FIG. 2*a* are always counted between edges of the signals 2*b, c, d*, the count values achieved in this way, which are entered in the FIGS. 2*b, c, d* are cylinder-specific so that from the comparison of these count values it is possible to detect how the instantaneous position of the crankshaft or camshaft is. In each case it is entered in the FIGS. 2*b, c, d* which cylinder 1 to 4, 1 to 5 or 1 to 6 is actually at its upper dead centre in which the ignition takes place (ZOT).

In the arrangement of the angular marks and gaps on the camshaft sensor wheel it is to be noted that the sensor signal has the transitions from high to low or low to high at the correct angular positions.

With the aid of a suitable arrangement of the angular marks and gaps on the camshaft sensor disc, the differences between the different long [sic] low phases and high phases can be made equal in magnitude so that the possibility of distinguishing them is also made as large as possible and the tolerance margins can be selected to be large.

In the control device 22, an assignment of the increments or angles in the low phases or high phases and of the reference mark is present so that a cylinder assignment together with the evaluation of the crankshaft signal is possible. By means of a refinement of the increments of the crankshaft signal, the resolution during the determination of the angles of the low phases and high phases is improved. Such a refinement of the increments is achieved in that five pulses are formed in the control device 22 for example from each pulse of the signal according to 2*a*.

Since deviations due to to mechanical and electrical tolerances can occur, during starting or operation the increments are learnt by comparison with values or angles, which are to be expected, of the low phases and high phases, so that a permanent correction is possible.

An arrangement of the angular marks in such a way that the edges with identical angular spacings are the rear edges of the high phases permits the following functions:

During starting, the first ignition outputs are generated with these edges.

When the crankshaft sensor fails, a cylinder assignment is achieved and emergency running realized with these angular marks alone.

In the case of variable camshaft adjustment, the adjustment angle can be detected by evaluating these edges.

The adaptation of the edges with identical angular spacings can be used for the exact outputting of the ignition or/and exact adjustment angle detection of a variable camshaft adjustment. With the found cylinder assignment, the time control is determined during the injection.

We claim:

1. A sensor arrangement for cylinder detection in a multi-cylinder internal combustion engine, comprising a sensor disc driveable by a crankshaft and having a multiplicity of angular marks and at least one distinguishable reference mark which is assigned to a fixed crankshaft angle; a sensor disc driveable by a camshaft and having a number of angular marks corresponding to a number of cylinders and having different lengths and different intermediate spaces; stationary detectors assigned to said sensor discs and, as a function of said marks passing by, outputting output signals with low phases and high phases; a control device evaluating said output signals so as to count the number of crankshaft pulses between a front edge and a rear edge of a camshaft sensor signal and to conclude an angular position of the camshaft from thusly obtained count values, said control device distinguishing identical angular marks with low phases and high phases of identical size by means of an additional detection of said reference mark so as to provide an unambiguous cylinder assignment within a segment with an extremely small number of different angular marks.

2. Sensor arrangement as defined in claim 1, wherein said control device being formed so as to detect from a sequence of count values which cylinder of the internal combustion engine is in an upper dead center.

3. Sensor arrangement as defined in claim 1, wherein said sensor disc which is driven by the camshaft is formed so that rear edges of a camshaft sensor signal have identical spacing.

4. Sensor arrangement as defined in claim 1, wherein the arrangement is formed so that during the start an ignition output is added to a first rear edge of a camshaft sensor signal after cylinder detection in order to ensure a quickest possible start.

5. Sensor arrangement as defined in claim 1, wherein the arrangement is formed so that in the event of a failure of a crankshaft sensor emergency running is activated and suitable edges of a camshaft sensor signal are used for cylinder detection and control of at least one of an ignition and injection.

6. Sensor arrangement as defined in claim 1, wherein the arrangement is formed so that in the event of a failure of a crankshaft sensor emergency running is activated and suitable edges of a camshaft sensor signal are used for cylinder detection and control of ignition and injection.

7. Sensor arrangement as defined in claim 1, wherein said control device is formed so that a sequence of the low phases and high phases of a camshaft sensor signal is compared with stored values which are to be expected, and in the case of deviation from the stored values at least one of an adaptation and correction is carried out.

8. Sensor arrangement as defined in claim 1, wherein said control device is formed so that a sequence of the low phases and high phases of a camshaft sensor signal is compared with stored values which are to be expected, and in the case of deviation from the stored values an adaptation and correction are carried out.

9. A method of cylinder detection in a multi-cylinder internal combustion engine, comprising the steps of driving by crankshaft a sensor disc having a multiplicity of angular marks and at least one distinguishable reference mark which is assigned to a fixed crankshaft angle; driving by a camshaft a sensor disc having a number of angular marks corresponding to a number of cylinders and having different lengths and different intermediate spaces; assigning stationary detectors to the sensor discs and, as a function of the mark passing by, outputting by the stationary detectors output signals with low phases and high phases; evaluating in a control device the output signals with low phases and high phases; counting a number of crankshaft pulses between a front edge and a rear edge of a camshaft sensor signal; and concluding an angular position of the camshaft from thusly counted values so that it is possible for identical angular marks with low phases and high phases of identical size to be distinguished by an additional detection of the reference mark so as to provide an unambiguous cylinder assignment within a segment with an extremely small number of different angular marks.

10. A method as defined in claim 9; and further comprising detecting from a sequence of count values which cylinder of the internal combustion engine is in an upper dead center.

11. A method as defined in claim 9; and further comprising providing identical spacing of rear edges of a camshaft sensor signal.

12. A method as defined in claim 9; and further comprising during a start, adding an ignition output to a first rear edge after cylinder detection in order to ensure a quickest possible start.

13. A method as defined in claim 9; and further comprising in the event of a failure of a crankshaft sensor, activating emergency running and using suitable edges of a camshaft sensor signal for cylinder detection and control of at least one of an ignition and an injection.

14. A method as defined in claim 9; and further comprising in the event of a failure of a crankshaft sensor, activating emergency running and using suitable edges of a camshaft sensor signal for cylinder detection and control of an ignition and injection.

15. A method as defined in claim 9; and further comprising comparing a sequence of the low phases and high phases of a camshaft sensor signal with stored values which are to be expected; and in the case of deviation from the stored value carrying out at least one of an adaptation and a correction.

16. A method as defined in claim 9; and further comprising comparing a sequence of the low phases and high phases of a camshaft sensor signal with stored values which are to be expected; and in the case of deviation from the stored value carrying out an adaptation and a correction.

* * * * *